United States Patent [19]

Kotzin

[11] 4,240,218

[45] Dec. 23, 1980

[54] AUDIO-VISUAL DISPLAY DEVICE

[76] Inventor: Garvin S. Kotzin, 20934 Hackney St., Canoga Park, Calif. 91316

[21] Appl. No.: 9,278

[22] Filed: Feb. 2, 1979

[51] Int. Cl.[3] ..... G09F 19/02

[52] U.S. Cl. ..... 40/407; 40/430; 40/439; 40/455; 428/13

[58] Field of Search ..... 40/455, 457, 439, 406, 40/407, 430, 412, 414, 477; 47/69, 79; 119/5; 428/13, 16, 27

[56] References Cited

U.S. PATENT DOCUMENTS

| | | | |
|---|---|---|---|
| 327,673 | 10/1885 | Gaillard | 47/79 X |
| 1,727,700 | 9/1929 | Dickson | 428/16 X |
| 2,751,880 | 6/1956 | Markowski | 119/5 |
| 2,922,253 | 1/1960 | Carter | 40/455 |
| 3,905,140 | 9/1975 | Damiano | 40/455 |
| 3,927,482 | 12/1975 | Marcus | 40/455 |
| 3,975,845 | 8/1976 | Millard | 40/430 X |
| 4,117,805 | 10/1978 | Ward | 119/5 |
| 4,180,932 | 1/1980 | Millard | 40/455 |

FOREIGN PATENT DOCUMENTS

| | | | |
|---|---|---|---|
| 1391684 | 11/1965 | France | 40/455 |

*Primary Examiner*—John F. Pitrelli
*Assistant Examiner*—G. Lee Skillington
*Attorney, Agent, or Firm*—Allan M. Shapiro

[57] ABSTRACT

Audio-visual display device is enclosed terrarium containing living plants of normal size. One or more models on small scale of living creatures are located in the terrarium and are powered to move. The small-scale models of the creatures have the effect of making the plants look larger. A pump to produce simulated rain or a music device to produce music are optional additions to enhance the effect.

10 Claims, 4 Drawing Figures

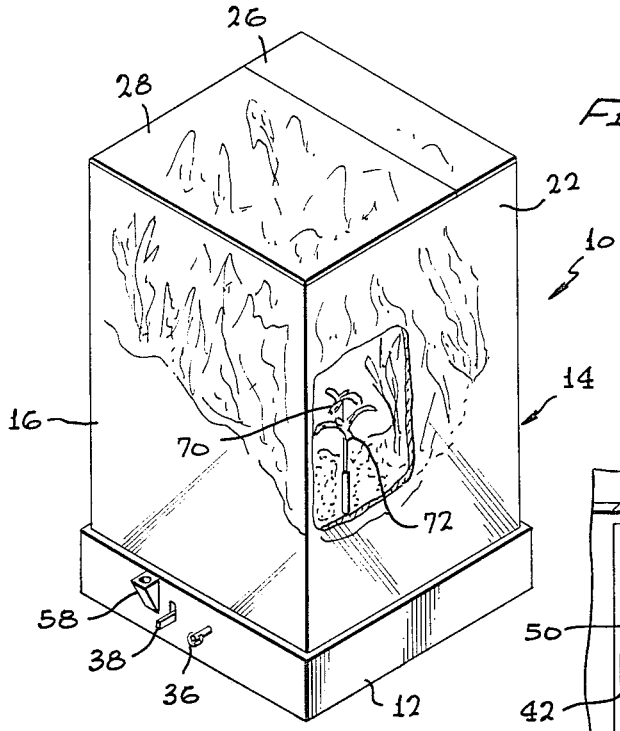
FIG. 1
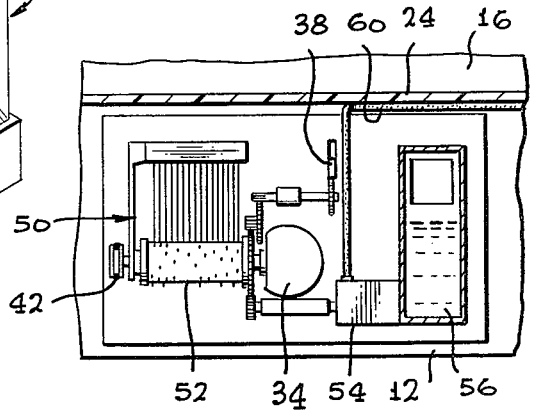
FIG. 3
FIG. 2
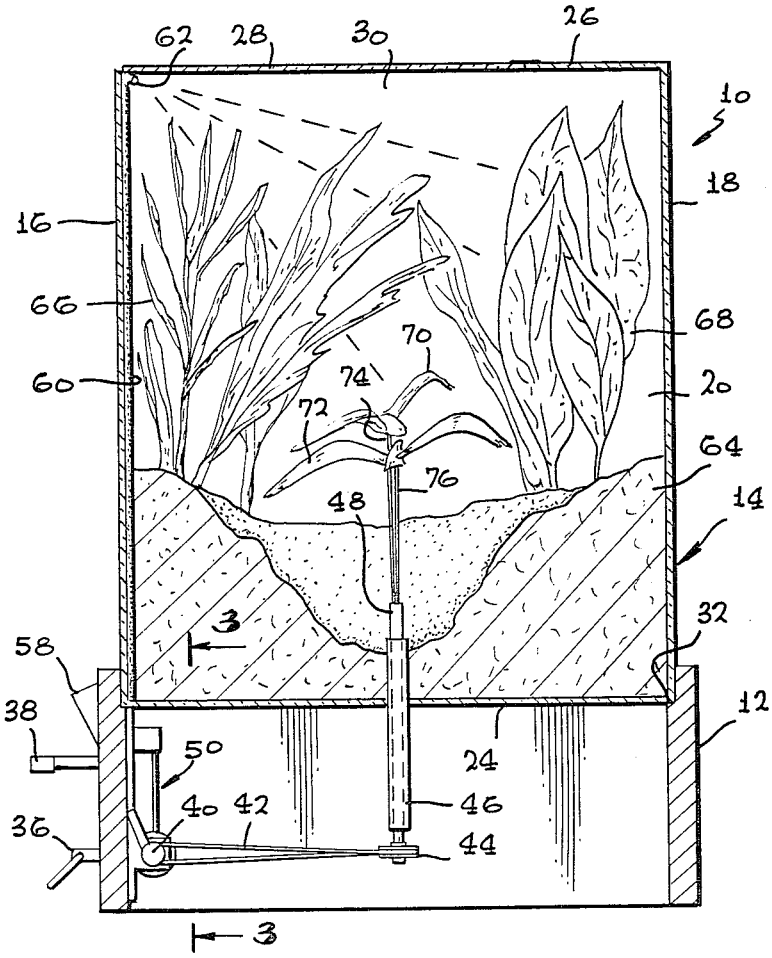
FIG. 4
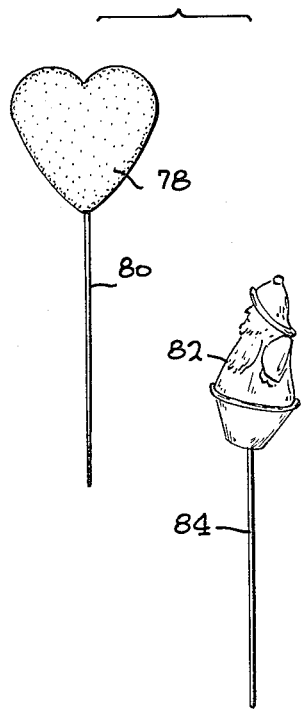

AUDIO-VISUAL DISPLAY DEVICE

BACKGROUND OF THE INVENTION

1. Field of the Invention

This invention is directed to an audio-visual display device in the nature of a terrarium having therein moving small-scale replicas of living creatures.

2. The Prior Art

Terrariums are well-known. They comprise enclosures which contain soil for the indoor growing of plants. They are characterized by total or almost total enclosure so that the humidity within the terrarium is usually higher than that of the surrounding room. At least one transparent sidewall in the terrarium permits light to reach the plants therein for purposes of growth and permits viewing and enjoyment of the scene including growing plants therein.

Some prior terrariums are known to have had fixed figures and artifacts therein on a miniature scale. For example, some prior terrariums were configured to have a gravel stripe therethrough, representing a stream, with a miniature bridge structure thereover. Sometimes, a miniature figure of a man would be included in such a terrarium. In all known prior art structures, such miniature figures were fixed and stationary.

SUMMARY OF THE INVENTION

In order to aid in the understanding of this invention, it can be stated in essentially summary form that it is directed to an audio-visual display device which includes a terrarium enclosure for containing growing plants therein, together with a miniature model therein mounted for motion in the terrarium so that the moving model gives the effect of larger plants. The provision of music and the provision of simulated rain are optional to enhance the effect.

It is thus an object of this invention to provide an audio-visual display device which simulates nature in that plants grow therein, but it is better than nature because the motion of miniature natural creatures in the terrarium gives the impression of larger plants. It is another object to provide an audio-visual display device wherein a natural environment is created for a miniature model of a creature, and the creature is powered to move. It is a further object to provide an audio-visual display device in the form of a terrarium which has simulated rain therein in addition to moving miniature creatures to simulate and enhance the effect of a natural environment. It is another object to provide music with the terrarium, together with motion of the miniature models of the natural creature to provide a pleasant environment for viewing of the audio-visual display device.

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings.

BRIEF DESCRIPTION OF THE DRAWINGS

FIG. 1 is an isometric view of the audio-visual display device of this invention.

FIG. 2 is an enlarged vertical section therethrough, with parts taken in section.

FIG. 3 is a further enlarged elevational view, as seen generally along the line 3—3 of FIG. 2, with parts broken away, showing the power mechanism, including the drive means for the miniature creatures, the musical source, and the pump for simulated rain.

FIG. 4 is an elevational view of two further model devices which can be employed in the audio-visual display device.

DESCRIPTION OF THE PREFERRED EMBODIMENT

The audio-visual display device of this invention is generally indicated at 10 in FIGS. 1 and 2. It comprises base 12 on which rests terrarium housing 14. Terrarium housing 14 has front 16, back 18, left end 20, right end 22, floor 24, and a fixed portion 26 at the top. In addition, cover 28 is openable and may be hinged to top portion 26. These parts are all secured together, except for cover 28, so as to make a rigid structure. Each of the parts is preferably transparent, except for floor 24 which may be of opaque material. Together they enclose space 30 which can be employed as a terrarium. The housing rests on shoulder 32, which is formed in base 12 to support the terrarium housing above the support surface.

Motor 34 is mounted within base 12. In the embodiment shown, it is a spring motor which is wound by key 36, which extends out of base 12. The running of motor 34 is controlled by switch 38, which also extends exteriorly of the base. When switch 38 is turned on, the motor is permitted to run. Instead of a spring-driven motor, an electric motor of either battery or power line drive can be employed.

Motor 34 drives pulley 40, which carries belt 42, see FIG. 2, which extends around capstan pulley 44. Bearing tube 46 is fixed in floor 24 and extends upward into the bottom of space 30. The capstan 48 is rotatably mounted in bearing tube 46 and carries capstan pulley 44 fixed at a lower portion thereof. The capstan 48 is also tubular, at least at its top end, to receive support for the various models of creatures.

Musical device 50 is illustrated as a tined drum 52 which drives tuned fingers as a music box construction. The drum is driven by motor 34. Drum 52 is preferably interchangeable so that an appropriate tune can be selected.

Motor 34 also drives pump 54, which takes water by suction from reservoir 56. Reservoir 56 can be filled through external filling spout, see FIGS. 1 and 2. Pump 54 discharges water through tube 60, which extends upward in housing 14 to terminate in a downwardly directed spray nozzle 62 to simulate rain within enclosed space 30.

Soil 64 is placed within housing 14, and natural sized plants are planted therein. Plants 66 and 68 illustrate two types of plants growing in soil 64 with their greenery extending well up in enclosed space 30.

In the preferred embodiment, small-scale models of natural creatures are mounted in capstan 48. In FIGS. 1 and 2, small-scale models 70 and 72 are models of birds. Preferably, two such models are used. Model 70 is mounted on wire 74, and model 72 is mounted on wire 76. These wires extend down into the tubular, open-top of capstan 48 so that, when the capstan turns, the models also turn. By providing this motion, nature is simulated; and, when the model creatures are moving, the viewer receives the visual effect of having larger plants therein. The natural size of the plants, coupled with the small-sized creatures which are moving, provides an illusion wherein the plants look larger to thus produce an enhanced impression of the entire audio-visual display device. The structure thus, on demand, produces the illusion of a natural environment which is created by the movement of the model creatures.

Alternative displays can be used in place of the model creatures illustrated in FIGS. 1 and 2. FIG. 4 illustrates heart symbol 78 mounted on wire 80, which can be used in addition to or in place of the creatures 70 and 72 by thrusting wire 80 down into the tubular, open top of capstan 48. FIG. 4 also illustrates model 82, which is a model of the mythical figure "Santa Claus." Model 82 is mounted on wire 84 so that model 82 may be used in addition to or in place of the creatures 70 and 72 by thrusting wire 84 into the open tubular top of capstan 48. Heart symbol 78 may be used to represent Valentine's Day, together with an appropriate tune from musical device 50 produced by a properly selected tined drum 52. Similarly, model 82 can be employed to represent the Christmas season, together with an appropriately selected tined drum 52. In this way, audio-visual display device 10 produces a simulated display of nature which, on demand, can rotate model creatures, produce music, and produce simulated rain within the enclosed space to provide a coordinated, advantageous display.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. An audio-visual display device comprising:

a housing for the containment of soil and for the containment of living, natural sized plants, said housing substantially enclosing a space in which the soil and plants are located, said housing having at least one transparent area for the entry of light into the enclosed space to aid in maintaining the living plants and for inspection of the enclosed space;

a motor; capstan in said enclosed space and driven by said motor, said capstan being an upright, open-top tube;

a model mounted in said capstan, said model being mounted on the wire which extends into said open top capstan tube so that said model is removably supported in said capstan tube, said model being a reduced-scale model of a natural creature, said model being positioned among the plants in said enclosed space for moving in said enclosed space to provide animation so that motion of said model of a natural creature in said space among the plants growing therein provides the illusion of a larger space and larger plants; and a music-producing instrument driven by said motor so that, when said capstan is moving, music is produced.

2. The audio-visual display device of claim 1 wherein said reduced scale model of a natural creature is a model of a bird.

3. The audio-visual display device of claim 2 wherein there are two reduced-scale model birds mounted in said capstan for movement with said capstan.

4. The audio-visual display device of claim 1 wherein said means for producing music has music selection means therein so that a musical tune appropriate to the particular model mounted on said capstan can be selected.

5. The audio-visual display device of claim 4 further including a water pump driven by said motor and a water reservoir connected to said pump to supply water to said pump, said pump having a spray nozzle positioned in said enclosed space so that, when said motor is running, simulated rain is delivered in said enclosed space.

6. The audio-visual display device of claim 1 further including a water pump driven by said motor and a water reservoir connected to said pump to supply water to said pump, said pump having a spray nozzle positioned in said enclosed space so that, when said motor is running, simulated rain is delivered in said enclosed space.

7. An audio-visual display device comprising:

housing walls defining a substantially enclosed space for the containment of soil and living plants therein, at least one of said walls of said housing being transparent to permit light to reach the growing plants and permit inspection of the enclosed space;

a capstan extending into said enclosed space and rotatably mounted with respect to said housing, said capstan being an open-top tube, a motor connected to said capstan for moving said capstan, a musical device connected to said motor for making music when said motor runs; and a reduced scale model of a natural creature mounted on a wire extending into said capstan tube so that said model is removably positioned in said enclosed space so that said model creature moves when said motor is running and provides the illusion of a larger space and larger plants therein.

8. The audio-visual display device of claim 7 wherein said model of a creature comprises two bird models.

9. The audio-visual display device of claim 7 wherein said musical device has selection means for selecting the music being played.

10. The audio-visual display device of claim 9 wherein a pump is connected to said motor and a reservoir is connected to said pump to supply water to said pump and a nozzle is positioned in said enclosed space and is connected to said pump so that, when said motor is running, water is delivered to said nozzle to simulate rain in said enclosed space.

* * * * *